US005336579A

United States Patent [19]

Zimmer et al.

[11] Patent Number: 5,336,579

[45] Date of Patent: Aug. 9, 1994

[54] COLOR DEVELOPER COMPOSITIONS CONTAINING BARE CARRIER CORES AND COATED CARRIER CORES

[75] Inventors: Charles D. Zimmer, Ontario; Edward J. Gutman; Mark D. Ballou, both of Webster, all of N.Y.

[73] Assignee: Xerox Corporation, Stamford, Conn.

[21] Appl. No.: 940,141

[22] Filed: Sep. 3, 1992

[51] Int. Cl.[5] ..... G03G 9/00

[52] U.S. Cl. ..... 430/106; 430/108; 430/109; 430/110

[58] Field of Search ..... 430/106, 106.6, 109, 430/110, 108

[56] References Cited

U.S. PATENT DOCUMENTS

| | | | |
|---|---|---|---|
| 3,713,819 | 1/1973 | Hagenbach et al. | 96/1 |
| 4,324,851 | 4/1982 | Lu et al. | 430/106 |
| 4,513,074 | 4/1985 | Nash et al. | 430/106.6 |
| 4,678,734 | 7/1987 | Laing et al. | 430/137 |
| 4,828,956 | 5/1989 | Creatura et al. | 430/137 |
| 4,935,326 | 6/1990 | Creatura et al. | 430/108 |
| 4,937,166 | 6/1990 | Creatura et al. | 430/108 |
| 4,948,686 | 8/1990 | Koch et al. | 430/45 |
| 5,100,753 | 3/1992 | Maniar et al. | 430/137 |
| 5,171,653 | 12/1992 | Jugle et al. | 430/108 |

FOREIGN PATENT DOCUMENTS

| | | | |
|---|---|---|---|
| 55-28001 | 2/1980 | Japan | 430/108 |
| 61-80263 | 4/1986 | Japan . | |
| 4-7562 | 1/1992 | Japan | 430/108 |

*Primary Examiner*—Steve Rosasco
*Attorney, Agent, or Firm*—Zosan S. Soong

[57] ABSTRACT

A developer composition containing color toner particles, bare carrier core particles and coated carrier particles.

28 Claims, 4 Drawing Sheets

COLOR DEVELOPER COMPOSITIONS CONTAINING BARE CARRIER CORES AND COATED CARRIER CORES

This invention relates generally to color developer compositions, and more specifically to color developer compositions containing a combination of bare carrier cores and carrier compositions, processes for the preparation thereof, and methods to increase the magnitude of the triboelectric charging value $A_t$, increase the conductivity, or both, of color developer compositions.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Many methods are known for applying the electroscopic particles to the electrostatic latent image to be developed. One development method, disclosed in U.S. Pat. No. 2,618,552, is known as cascade development. Another technique for developing electrostatic images is the magnetic brush process, disclosed in U.S. Pat. No. 2,874,063. Other techniques, such as touchdown development, powder cloud development, and jumping development are known to be suitable for developing electrostatic latent images.

Various developer compositions, carrier compositions, and processes for the preparation thereof are known:

Nash et al., U.S. Pat. No. 4,513,074, discloses a developer composition containing uncoated ferrite carrier particles.

Maniar et al., U.S. Pat. No. 5,100,753, discloses processes for the preparation of coated carrier particles.

Creatura et al., U.S. Pat. No. 4,828,956, discloses processes for maintaining the triboelectric stability of developers.

Koch et al., U.S. Pat. No. 4,948,686, discloses a process for forming two-color images.

Laing et al., U.S. Pat. No. 4,678,734, discloses a process for preparing developer compositions.

Creatura et al., U.S. Pat. No. 4,935,326, discloses carrier particles coated with polymer mixture.

Creatura et al., U.S. Pat. No. 4,937,166, discloses carrier particles coated with polymer mixture.

SUMMARY OF THE INVENTION

It is an object in embodiments of the present invention to provide a color developer composition containing a combination of bare carrier core particles and coated carrier particles exhibiting an increase in the magnitude of the triboelectric charging value $A_t$, an increase in the conductivity value, or both, as compared with a color developer containing only coated carrier particles.

It is a further object to provide in embodiments a method for increasing the magnitude of the triboelectric charging value $A_t$, increasing the conductivity value, or both, for color developers, preferably red, green, and blue developer compositions.

It is an additional object to provide in embodiments color developer compositions which exhibit relatively stable triboelectric charging values.

These objects and others are met by providing a developer composition comprising color toner particles, bare carrier core particles, and coated carrier particles.

The phrase "coated carrier particles" encompasses carrier particles with continuous coatings and semi-continuous, partial coatings. Semi-continuous, partial coatings may result from the coating process for carrier cores or from aging as contact among carrier and/or toner particles gradually abrades a portion of the coating from the coated carrier particles. Also, the term "color" encompasses colored pigments and dyes, including blends of two or more colorants. Black colorants are encompassed within certain embodiments of the present invention as one colorant of a mixture of two or more colors. Black developers containing a combination of bare carrier core particles and coated carrier particles are illustrated in a co-pending application (Maniar et al., attorney docket number D/92087, entitled "Black Developer Compositions Containing Bare Carrier Cores") which is filed concurrently with the present application, the disclosure of which is totally incorporated by reference.

BRIEF DESCRIPTION OF THE DRAWINGS

Other aspects of the present invention will become apparent as the following description proceeds and upon reference to the Figures, in which.

DETAILED DESCRIPTION

Figure 1:
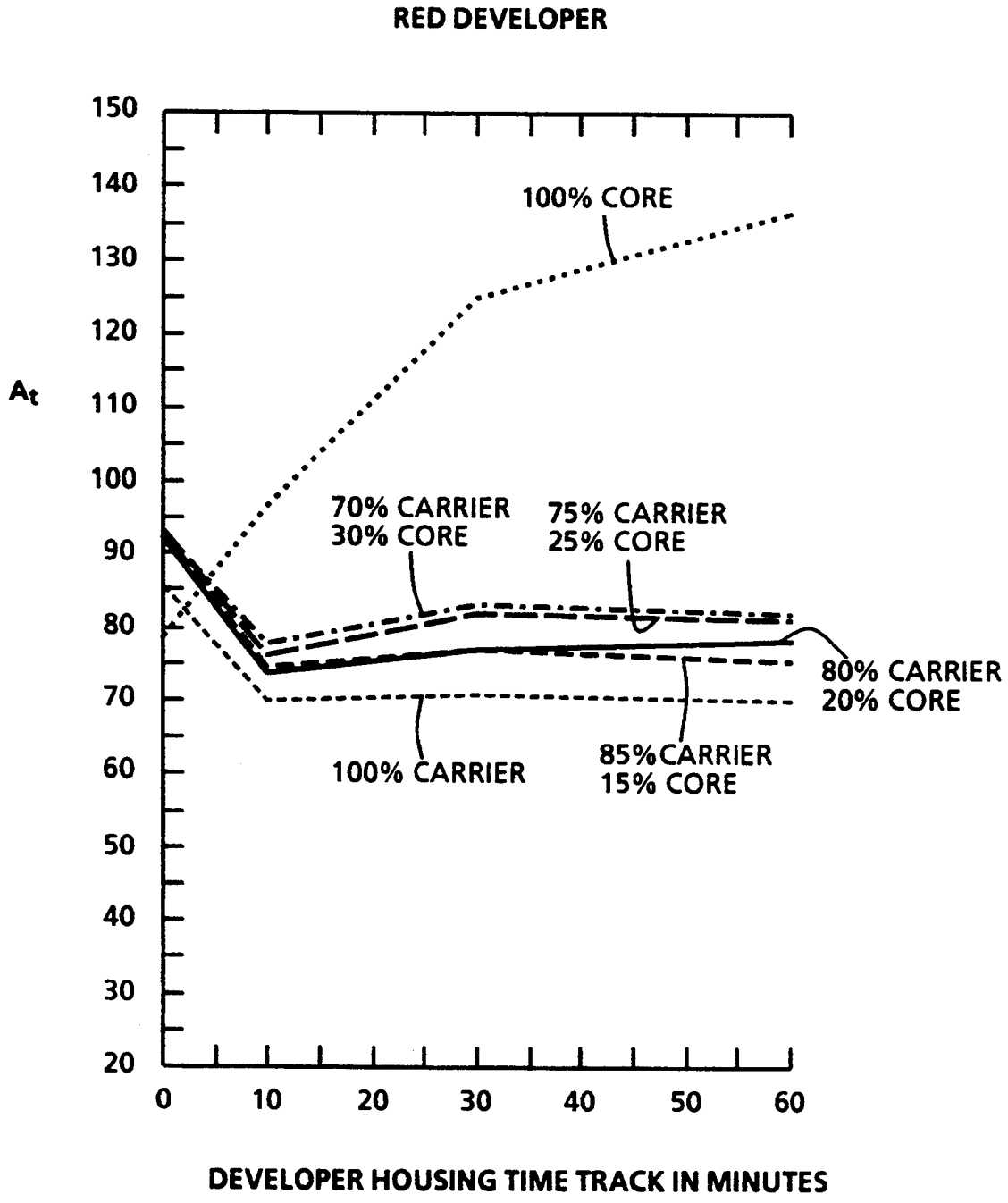
FIG. 1 illustrates how $A_t$ is affected by varying the proportions of bare carrier core particles and coated carrier particles for a particular red toner.

The developer compositions of the present invention comprise toner particles, bare carrier core particles and coated carrier particles. The bare carrier core particles may be present in any effective amount, preferably from about 5% to about 75% by weight, more preferably from about 5% to about 50% by weight, and most preferably from about 10% to about 40% by weight, based on the total weight of the bare carrier core particles and the coated carrier particles. In embodiments of the present invention, the developer composition may be prepared by adding the bare carrier core particles and coated carrier particles to the toner particles without any mixing. For example, replenisher developer compositions ("replenisher"), which are added to electrostatographic printing and copying devices to refill their developer stocks, may be unmixed so that the carrier particles, both coated and bare, remain segregated from the toner particles in the replenisher. In the developer sump of the electrostatographic printing and copying devices, mixing of the components of the replenisher may occur by suitable mechanical means such as by a mixing wheel. Preferably, in the developer composition of the present invention, carrier particles, both bare and coated, are mixed with the toner particles by any suitable means. For example, the developer components may be mixed by a variable speed mixer at any effective mixing speed such as from about 100 rpm to about 500 rpm, and preferably from about 200 to about 300 rpm. In embodiments of the present invention, increasing the blending speed for the color developers may raise their triboelectric charging values. For example, during preparation of a blue developer containing 75% by weight coated carrier particles and 25% by weight bare carrier core particles, increasing the blending speed from 200 rpm for 10 minutes to 300 rpm for 10 minutes may raise the $A_t$ values by up to about 10 units for a period of time.

In embodiments, the combination of bare carrier core particles and coated carrier particles may increase or decrease the magnitude of the triboelectric charging values of the color developers from about 1 to about 50 microcoulombs per gram of developer, preferably from about 5 to about 20 microcoulombs per gram, and more preferably from about 11 to about 18 microcoulombs per gram, as compared with a developer containing 100% by weight of coated carrier particles. Preferably, the combination of bare carrier core particles and coated carrier particles increases the magnitude of the triboelectric charging values and $A_t$ of both positively and negatively charging color developers. A known measure of triboelectric charging values is $A_t$ which is defined as: $A_t$=triboelectric charging value x (Tc+K). The term "Tc" represents toner concentration. The value "K" is a value ranging from 0 to about 10, and preferably 1. The value "K" is a function of the toner and carrier sizes and is generally constant for fixed toner and carrier sizes. Both $A_t$ and the triboelectric charging value may be positive or negative, depending upon the polarity of the toner. The triboelectric value $A_t$ is discussed, for example, in E. J. Gutman et al., Triboelectric Properties of Two-Component Developers for Xerography, Journal of Imaging Science and Technology, Vol. 36, No. 4, pp. 335–349 (July–August 1992), the disclosure of which is totally incorporated by reference.

It is believed that $A_t$ substantially reduces the influence of toner concentration on triboelectric charging values. Because $A_t$ is directly correlated to triboelectric charging values as reflected in the above equation, it is understood that generally any discussion of $A_t$ or triboelectric values is applicable to the other. For example, discussion that embodiments of the present invention may result in an increase in the magnitude of $A_t$ of the color developers also suggests an increase in the magnitude of the triboelectric charging values; but for xerographic development systems operating at constant triboelectric values, an increase in the magnitude of $A_t$ will be reflected in an increase in toner concentration. In embodiments, the present invention may increase or decrease the magnitude of $A_t$ by about 600 or less, preferably about 300 or less, and more preferably by about 200 or less ($A_t$ is in units of $10^{-2}$ micro-Coul/g), as compared with a developer containing 100% by weight of coated carrier particles. In embodiments where there is an increase in the magnitude of the triboelectric charging value, and consequently an increase in the magnitude of $A_t$, bare core particles charge to a higher magnitude than the coated carrier particles, thus enabling the color toner particles to charge to a higher magnitude, but in the opposite polarity. Triboelectric charging values may be determined by any suitable method including the known Faraday Cage technique. In embodiments of the present invention, color developers, especially those containing red, green, or blue toners, may exhibit relatively stable $A_t$ values during the operation of electrostatographic printing and coping devices even after many thousands of copies, such as 100,000 copies.

In embodiments, the combination of bare carrier core particles and coated carrier particles increases the conductivities of the color developers by about a factor of 10 mho(cm)$^{-1}$ or less, preferably from about 2 to about 400 mho(cm)$^{-1}$, and more preferably from about 2 to about 10 mho(cm)$^{-1}$, as compared with a developer containing 100% by weight of coated carrier particles. Conductivities may be determined in a magnetic brush conductivity cell. Magnetic brush conductivity cells are illustrated in Cellini et al., U.S. Ser. No. 07/739,034, filed Aug. 1, 1991, the disclosure of which is totally incorporated by reference. The bare carrier core particles have higher conductivity than the coated carrier particles. A mixture will have a conductivity intermediate between the coated and uncoated particles.

Suitable toner particles may be of any composition suitable for development of electrostatic latent images, such as those comprising a resin and a colorant. Various suitable resins may be selected for the toner compositions of the present invention. Examples of suitable toner resins include crosslinked resins including crosslinked polyesters (reference for example copending U.S. Ser. Nos. 07/814,641 and 07/814,782, the disclosures of which are totally incorporated by reference), styrene acrylates, styrene methacrylates, styrene butadienes, polyimides, epoxies, diolefins, polyurethanes, vinyl resins, and polyesters, such as the polymeric esterification products of a dicarboxylic acid and a diol comprising a diphenol. Any suitable vinyl resin may be selected for the toner resins of the present application, including homopolymers or copolymers of two or more vinyl monomers. Typical of such vinyl monomeric units include: styrene, p-chlorostyrene, vinyl naphthalene, unsaturated mono-olefins such as ethylene, propylene, butylene, and isobutylene; vinyl halides such as vinyl chloride, vinyl bromide, vinyl fluoride, vinyl acetate, vinyl propionate, vinyl benzoate, vinyl butyrate, and the like; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylimide; vinyl ethers, such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like. Also useful are styrene butadiene copolymers, Pliotone®, available from Goodyear Company, and mixtures thereof. Particularly preferred are a resin comprising poly-n-butylmethacrylate; a copolymer of styrene/butadiene which comprises 87 percent by weight of styrene and 13 percent by weight of butadiene; a copolymer of styrene/n-butylmethacrylate crosslinked with divinylbenzene 20–50% gel which comprises 50–60 percent by weight of styrene, 50–40 percent by weight of n-butyl methacrylate, and 0.1–0.3 percent by weight of divinylbenzene; and a copolymer of styrene/n-butyl methacrylate which comprises 50–60 percent by weight of styrene and 50–40 percent by weight of n-butyl methacrylate. The resin or resins are generally present in an amount of from about 30 to about 99 percent by weight of the toner composition, preferably from about 50 to about 99 percent by weight, and more preferably from about 70 to about 95 percent by weight, although they may be present in greater or lesser amounts.

Suitable pigments or dyes selected as colorants for the toner particles include carbon black, nigrosine dye, aniline blue, magnetites, and mixtures thereof, with carbon black being the preferred colorant. The pigment should be present in an amount sufficient to render the toner composition highly colored to permit the formation of a clearly visible image on a recording member. Generally, the pigment particles are present in amounts of from about 1 percent by weight to about 20 percent by weight based on the total weight of the toner composition; however, lesser or greater amounts of pigment particles may be present provided that the objectives of the present invention are achieved.

When the pigment particles are magnetites, which comprise a mixture of iron oxides ($Fe_3O_4$) such as those commercially available as Mapico Black, these pigments are present in the toner composition in an amount of from about 10 percent by weight to about 70 percent by weight, and preferably in an amount of from about 20 percent by weight to about 50 percent by weight, although they may be present in greater or lesser amounts, provided that the objectives of the invention are achieved.

Colored toner pigments are also suitable for use with the present invention, including red, green, blue, brown, magenta, cyan, and yellow particles, as well as mixtures thereof, wherein the colored pigments are present in amounts that enable the desired color. Illustrative examples of suitable magenta pigments include 2,9-dimethyl-substituted quinacridone and anthraquinone dye, identified in the color index as Cl 60710, Cl Dispersed Red 15, a diazo dye identified in the color index as Cl 26050, Cl Solvent Red 19, and the like. Illustrative examples of suitable cyan pigments include copper tetra-4-(octadecyl sulfonamido) phthalocyanine, copper phthalocyanine pigment, listed in the color index as Cl 74160, Pigment Blue, and Anthradanthrene Blue, identified in the color index as Cl 69810, Special Blue X-2137, and the like. Illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33, 2,5-dimethoxy-4-sulfonanilide phenylazo-4'-chloro-2,5-dimethoxy acetoacetanilide, Permanent Yellow FGL, and the like. Other suitable toner colorants include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FG1 (Hoechst), Permanent Yellow YE 0305 (Paul Uhlich), Lumogen Yellow D0790 (BASF), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Color pigments and dyes are generally present in an effective amount of from, for example, about 1 weight percent to about 20 weight percent based on the weight of the toner resin particles, although lesser or greater amounts may be present provided that the objectives of the present invention are met.

Suitable effective internal and external charge control additives can be incorporated into or on the surface of the toner compositions of the present invention, such as quaternary ammonium compounds, as disclosed in U.S. Pat. No. 4,937,157 and U.S. Pat. No. 4,904,762, the disclosures of which are totally incorporated by reference; alkyl pyridinium compounds, including cetyl pyridinium halides and cetyl pyridinium tetrafluoroborates, as disclosed in U.S. Pat. No. 4,298,672, the disclosure of which is totally incorporated herein by reference; organic sulfate and sulfonate compounds, as disclosed in U.S. Pat. No. 4,338,390, the disclosure of which is totally incorporated herein by reference; and the like. Particularly preferred as a charge control agent is a quaternary ammonium salt selected from the group consisting of: dimethyldistearylammonium bisulfate; dimethyldistearylammonium methylsulfate; dimethyldistearylammonium sulfate; cetylpyridinium chloride; dimethyldistearylammonium hexafluorophosphate; and alkylammonium naphtholsulfonate. The charge enhancing additives are usually present in the final toner composition in an amount of from about 0.1 percent by weight to about 20 percent by weight.

External additives may also be present in the above described toners in instances such as when toner flow is to be assisted, or when lubrication is desired to assist a function such as cleaning of the photoreceptor. The amounts of external additives are measured in terms of percentage by weight of the toner composition. For example, a toner composition containing a resin, a pigment, and an external additive may comprise 80 percent by weight resin and 20 percent by weight pigment, and may also comprise 0.2 percent by weight of an external additive. External additives may include any additives suitable for use in electrostatographic toners, including fumed silica, silicon derivatives such as Aerosil R972®, available from Degussa, Inc., ferric oxide, hydroxy terminated polyethylenes such as Unilin, polyolefin waxes, polymethylmethacrylate, zinc stearate, chromium oxide, aluminum oxide, titanium oxide, stearic acid, polyvinylidene fluorides such as Kynar®, and other known or suitable additives. External additives may be present in various effective amounts, provided that the objectives of the present invention are achieved. Preferably, external additives are present in an amount of from about 0.1 to about 4 percent by weight, and more preferably from about 0.5 to about 1 percent by weight.

Toner particles may be of any suitable size such as between about 0.1 and about 100 microns, and preferably from about 6 to about 20 microns in diameter.

The toner compositions may be prepared by any suitable method. For example, a method known as spray drying entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a pigmented resin, which are then attrited and classified by particle size.

One specific suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size to enable toner particles with an average volume particle diameter of from about 10 to about 20 microns. A third suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size. Other similar blending methods may also be used such as melt dispersion, dispersion polymerization, and suspension polymerization. Subsequent to size classification of the toner particles, any external additives are blended with the toner particles. The resulting toner composition is then mixed with carrier particles in any effective concentration, for example, such that the toner is present in an amount of about 1 to about 5 percent by weight, preferably from about 2 to about 4 percent by weight by weight, and most preferably about 3 percent by weight of the carrier (both bare carrier core particles and coated carrier particles). Different toner to carrier ratios are acceptable, provided that the objectives of the present invention are achieved.

The core of the coated carrier particles and the bare carrier core particles may be the same or different material. Carrier particles selected for the present invention may be chosen from a number of known materials, provided that the objectives of the invention are achieved. Illustrative examples of suitable carrier particles include granular zircon, steel, nickel, iron, ferrites like Cu/Zn/Ni ferrite, and the like. Other suitable carrier particles include nickel berry carriers as disclosed in U.S. Pat. 3,847,604, the disclosure of which is totally incorporated herein by reference. These carriers comprise nodular carrier beads of nickel characterized by surfaces of reoccurring recesses and protrusions that provide the particles with a relatively large external area. In a preferred embodiment, the core of the coated carrier particles and the bare carrier core particles are Hoeganaes Anchor Steel Core, available from Hoeganaes Corp. or Toniolo Steel Core, available from Metallurgica Toniolo S.p.A., Maerne, Italy, both optionally unoxidized.

Any suitable coating material may be used to coat the selected core particles, resulting in the coated carrier particles. Examples of suitable coating materials include resins such as polystyrene, homopolymers, copolymers, and terpolymers; polymers of halogen containing ethylenes including vinyl fluorides, vinylidene fluorides, vinyl chlorides, vinylidene chlorides, chlorotrifluoroethylene, a vinyl chloride/chlorotrifluoroethylene copolymer, a vinyl chloride/vinyl acetate copolymer, a chlorotrifluoroethylene polymer, and various known vinyl chloride terpolymers. Acrylic polymers and copolymers typified by polymethylmethacrylate and siloxane polymers are also useful carrier coatings, particularly when negative charging toners are desired. Preferably, carrier coatings are present in an amount of from about 0.1 to about 1 percent by weight of the uncoated carrier particle, although other amounts are suitable provided that the objectives of the present invention are achieved. Coated and bare carrier particles generally may have a diameter of, for example, from about 25 to about 1,000 microns, and preferably about 40 to about 150 microns, thus allowing these particles to possess sufficient density and inertia to avoid adherence to the electrostatic image during the development process. Many of the typical carriers that can be used are described in U.S. Pat. Nos. 2,618,441; 2,638,522; 3,533,835; 3,526,533; 3,590,000; 3,847,604; 3,767,598; 4,233,387; 4,935,326; and 4,937,166, the disclosures of which are totally incorporated by reference.

Coating of the carrier particles may be by any suitable process, such as powder coating, wherein a dry powder of the coating material is applied to the surface of the carrier particle and fused to the core by means of heat; solution coating, wherein the coating material is dissolved in a solvent and the resulting solution is applied to the carrier surface by tumbling; or fluid bed coating, in which the carrier particles are blown into the air by means of an air stream, and an atomized solution comprising the coating material and a solvent is sprayed onto the airborne carrier particles repeatedly until the desired coating weight is achieved.

Figure 2:
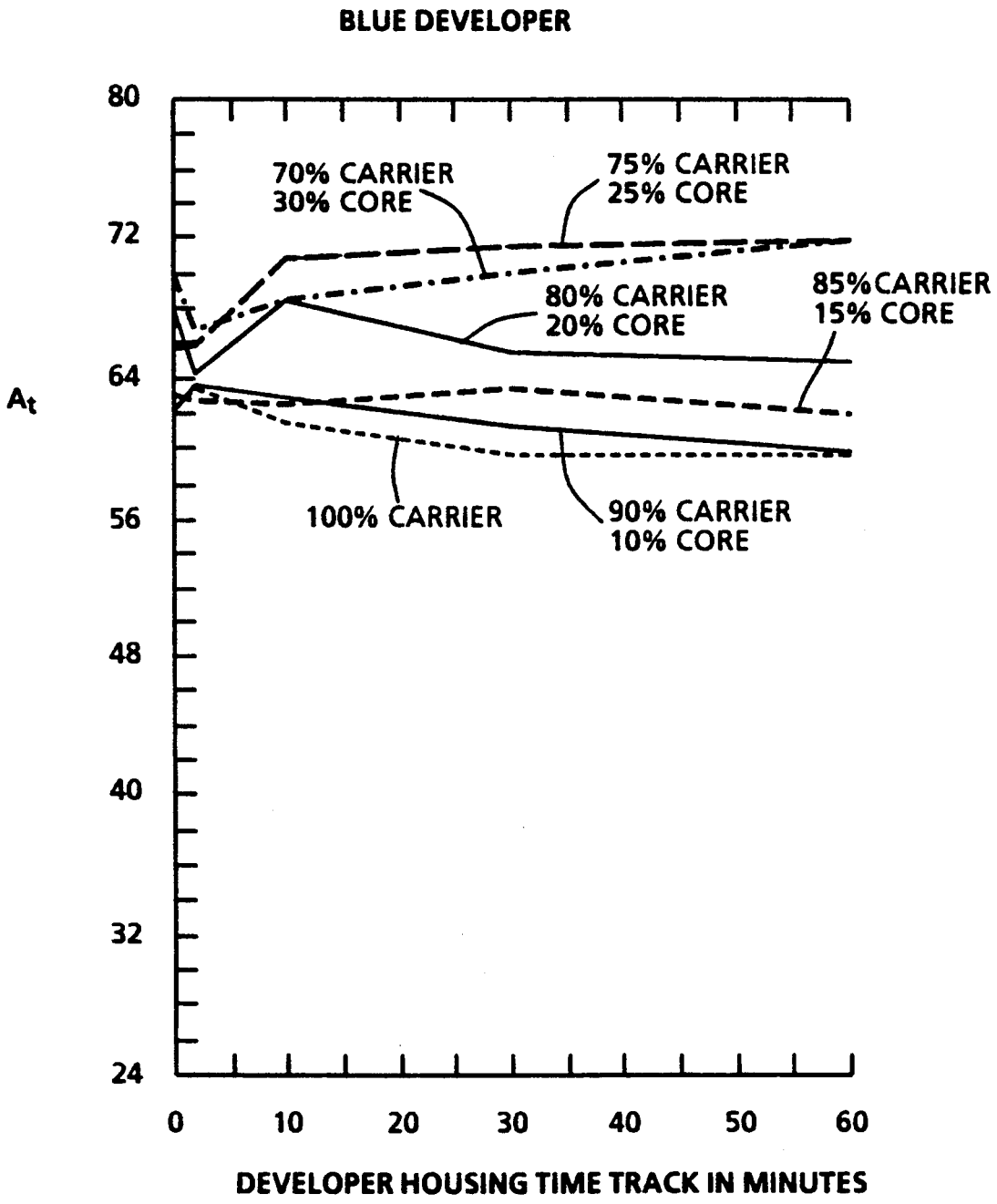
FIG. 2 illustrates how $A_t$ is affected by varying the proportions of bare carrier core particles and coated carrier particles for a particular blue toner.
Figure 3:
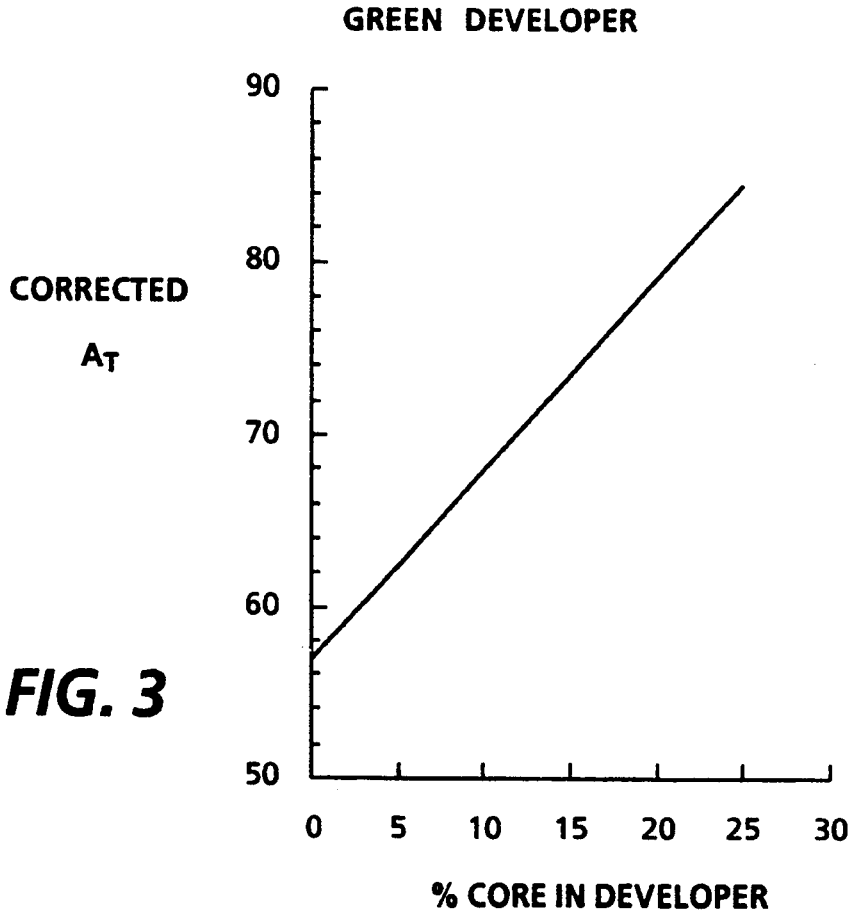
FIG. 3 illustrates how $A_t$ is affected by varying the proportions of bare carrier core particles and coated carrier particles for a particular green toner.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated. In the following examples, triboelectric values were determined by the Faraday Cage technique, the $A_t$ values reflected "K" being equal to 1, and the $A_t$ values were determined to be negative values, but for simplicity, FIGS. 1-3 showed positive $A_t$ values.

EXAMPLE 1

Preparation and Testing of Red Developers

Six red developers having respectively 100% by weight coated carrier; 100% by weight bare carrier core; 85% coated carrier and 15% by weight bare carrier core; 80% coated carrier and 20% by weight bare carrier core; 75% coated carrier and 25% by weight bare carrier core; and 70% coated carrier and 30% by weight bare carrier core were prepared with the following compositions: toner resin: 91.7% styrene butadiene resin, wherein the copolymers were present in a ratio by weight of 90.5% styrene/9.5% butadiene; red pigment: 6.7% Pigment Red 48:1 C.I. 15865:1; magenta dispersion: 0.6% magenta dispersion was prepared by flushing a Hostaperm Pink E pigment with a 65% styrene/35% n-butylmethacrylate resin in a 50%/50% ratio; 1% dimethyl distearyl ammonium methyl sulfate (DDAMS); external additives: 0.3% Zinc Stearate/0.3% Aerosil R972; bare carrier core: unoxidized Hoeganaes steel core having a diameter of 131 microns by sieve measurement; and coated carrier: unoxidized Hoeganaes steel core having a diameter of 131 microns by sieve measurement.

Coating was solution coated, weighed about 0.8% by weight based on the weight of the uncoated core, and comprised 80% by weight of polymethyl methacrylate and 20% by weight carbon black Vulcan 72R. The volume median diameter of the toner particles was about 12.5 microns.

The red developers were blended in a Littleford MSR variable speed mixer using 18 pounds at 300 rpm for 10 minutes at 3.1% toner concentration, except for the developer containing 100% by weight of coated carrier which was mixed at 200 rpm. For each of the red developers, about 7.5 pounds of the developer was placed in a Xerox 4850 developer subsystem (utilizing magnetic brush development) mounted on a bench top; the triboelectric charge of the developer was measured at fixed intervals of mixing time in this fixture.

Figure 4:
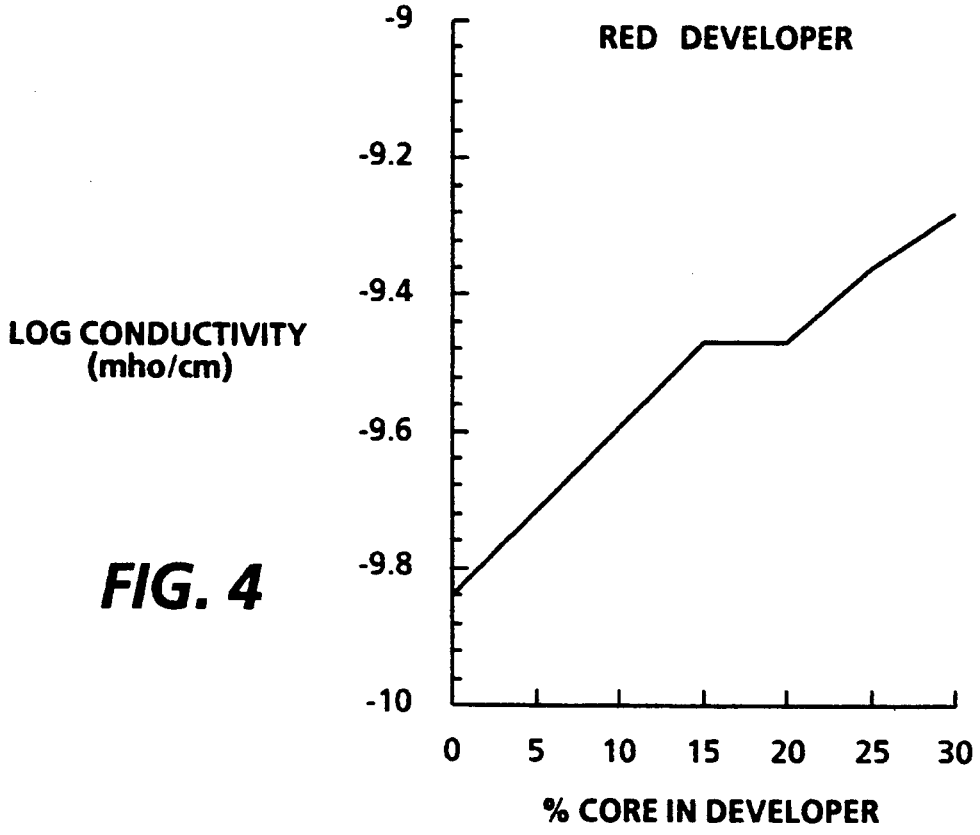
FIG. 4 illustrates how conductivity values are affected by varying the proportions of bare carrier core particles and coated carrier particles for a particular red toner.

In FIG. 1, developers of the present invention, containing the combination of coated carrier particles and bare carrier core particles, exhibited an increase in the magnitude of $A_t$ as compared with the $A_t$ values for the developer containing 100% by weight coated carrier. Moreover, like that shown by the comparison developer having 100% by weight coated carrier, the $A_t$ values demonstrated by developers of the present invention were relatively stable over time. As seen in FIG. 4, the red developer exhibited an increase in conductivity as the percentage of bare core particles increased.

EXAMPLE 2:

Preparation and Testing of Blue Developers

Six blue developers were prepared and tested in the same manner as described in Example 1, except for the following differences. Blue pigment about 6.5% Pigment Blue 15-3 C.I. 74160; 2% Bontron E-88 from Orient Chemical; 0.5% Cetyl pyridinium chloride were used in place of red pigment and DDAMS. In addition, the styrene butadiene resin was present in an amount of 91% by weight. Also, in Example 2, there was no developer containing 100% by weight of bare core particles. Instead, there was a blue developer containing 90% coated carrier and 10% by weight bare carrier core.

Figure 5:
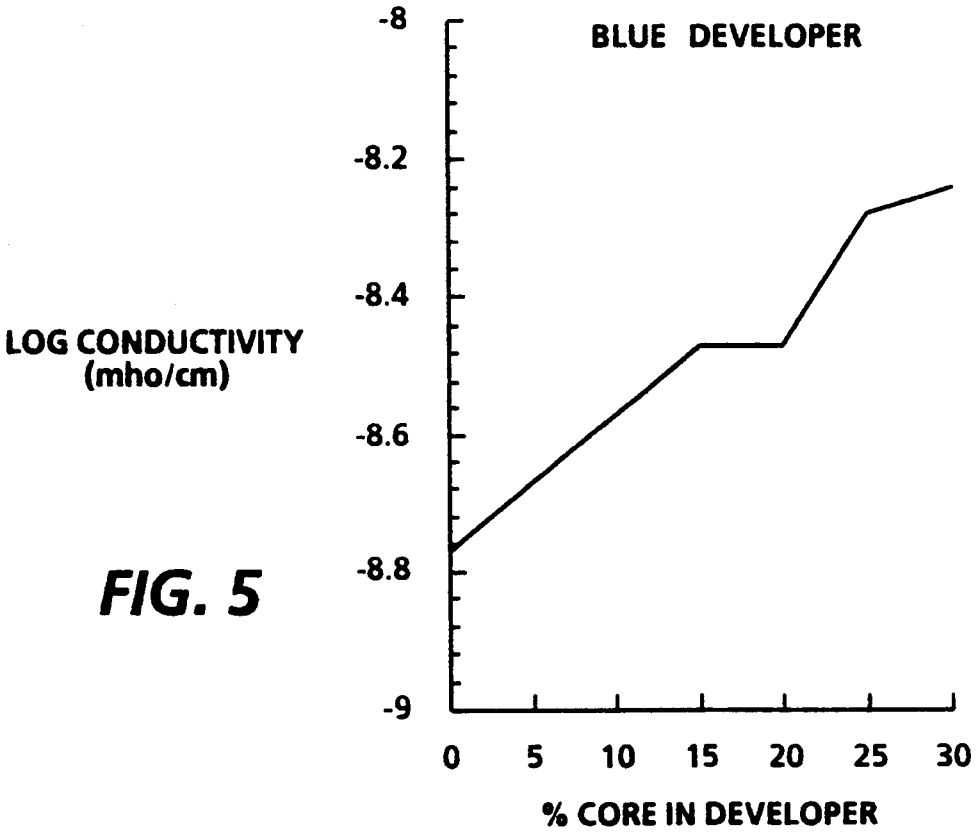
FIG. 5 illustrates how conductivity values are affected by varying the proportions of bare carrier core particles and coated carrier particles for a particular blue toner.

In FIG. 2, developers of the present invention, containing the combination of coated carrier particles and bare carrier core particles, exhibited an increase in the magnitude of $A_t$ as compared with the $A_t$ values for the developer containing 100% by weight coated carrier. Moreover, like that shown by the comparison developer having 100% by weight coated carrier, the $A_t$ values demonstrated by developers of the present invention were relatively stable over time. As seen in FIG. 5, the blue developer exhibited an increase in conductivity as the percentage of bare core particles increased.

EXAMPLE 3:

Preparation and Testing of Green Developers

Green developers were prepared and tested in the same manner as described in Example 1, except for the following differences. Three green developers having respectively 100% by weight coated carrier; 15% bare carrier core and 85% coated carrier; and 25% bare carrier core and 75% coated carrier. The toner compositions comprised 92% by weight of the toner resin and 7% Pigment Green 36 C.I. 74265, instead of the 91.7% toner resin and the pigments employed in Example 1. In addition, the green developers were placed in a Xerox 4850 laser printer (utilizing magnetic brush development) instead of the Xerox 4850 developer subsystem.

Figure 6:
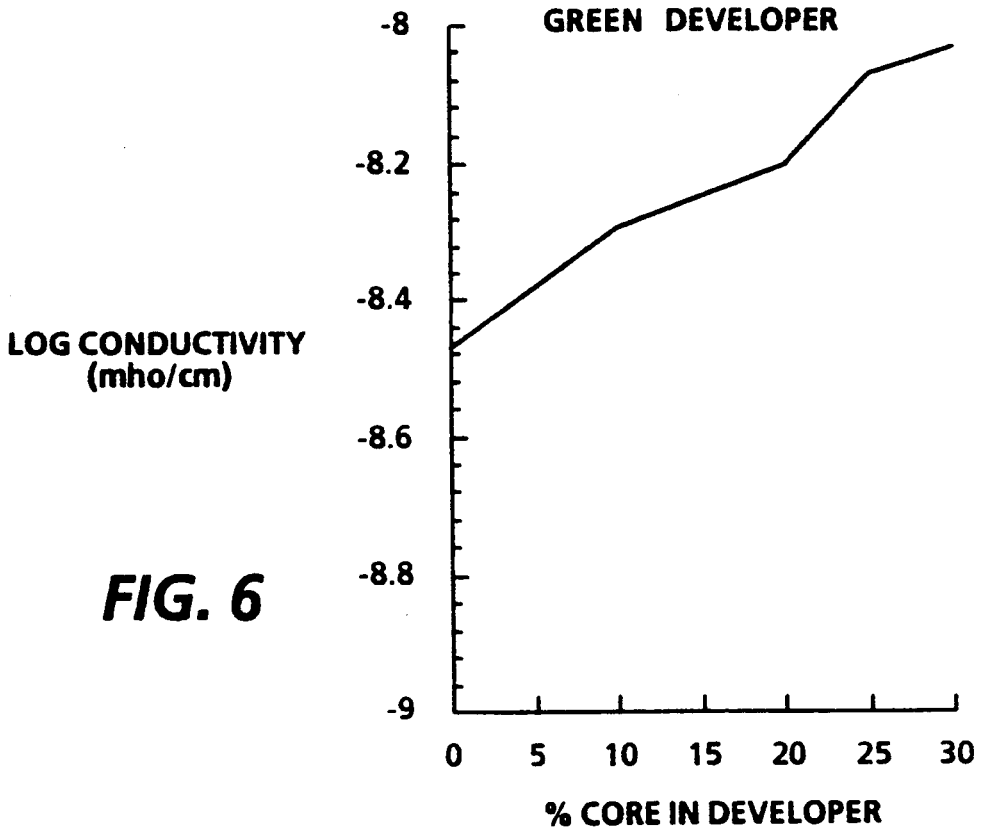
FIG. 6 illustrates how conductivity values are affected by varying the proportions of bare carrier core particles and coated carrier particles for a particular green toner.

The results were displayed in FIG. 3, which indicated a linear relationship between $A_t$ and the percentage of bare core particles in the developer. In FIG. 3, corrected $A_t$ indicates that the values have been adjusted to compensate for the effects of temperature and relative humidity. Temperature and relative humidity were determined by conventional methods such as a Bendix Psychromoter, model number 566. The readings were converted to the moisture content of the air as measured by grains of water. A calibration curve was obtained by measuring $A_t$ as a function of grains of water in the air. The data were determined at lab ambient and then adjusted to 52.5 grains of water by using the calibration curve. As seen in FIG. 6, the green developer exhibited an increase in conductivity as the percentage of bare core particles increased.

Other modifications of the present invention may occur to those skilled in the art based upon a reading of the present disclosure and these modifications are intended to be included within the scope of the present invention.

We claim:

1. A developer composition comprising color toner particles, bare carrier core particles and coated carrier particles, wherein the color toner particles comprise red colorant particles, blue colorant particles, or green colorant particles, wherein the bare carrier core particles are present in an amount ranging from about 10% to about 40% by weight for the developer composition comprised of the blue colorant particles or the red colorant particles, and wherein the bare carrier core particles are present in an amount ranging from about 10% to about 20% by weight for the developer composition comprised of the green colorant particles, based on the total weight of the bare carrier core particles and the coated carrier particles.

2. The developer composition of claim 1, wherein the color toner particles comprise a mixture of two or more colorants.

3. The developer composition of claim 1, wherein there is selected the color toner particles comprised of the blue colorant particles.

4. The developer composition of claim 1, wherein the color toner particles comprise Pigment Blue 15-3 C.I. 74160 pigment particles.

5. The developer composition of claim 1, wherein there is selected the color toner particles comprised of the green colorant particles.

6. The developer composition of claim 1, wherein the color toner particles comprise Pigment Green 36 C.I. 74265 pigment particles.

7. The developer composition of claim 1, wherein there is selected the color toner particles comprised of the red colorant particles.

8. The developer composition of claim 1, wherein the color toner particles comprise Pigment Red 48:1 C.I. 15865-1 particles.

9. The developer composition of claim 1, wherein the bare carrier core particles are steel particles, optionally unoxidized.

10. The developer composition of claim 1, wherein the bare carrier core particles are comprised of Hoeganaes Anchor Steel Core or Toniolo Steel Core.

11. The developer composition of claim 1, wherein the color toner particles, bare carrier core particles and coated carrier particles are mixed.

12. The developer composition of claim 1, wherein the color toner particles, bare carrier core particles and coated carrier particles are unmixed.

13. The developer composition of claim 1, wherein the toner particles are present in an amount ranging from about 0.5% to about 8% by weight based on the total weight of the bare carrier core particles and the coated carrier particles.

14. The developer composition of claim 1, wherein the core material of the coated carrier particles and the bare carrier core particles are equivalent.

15. The developer composition of claim 1, wherein the core material of the coated carrier particles and the bare carrier core particles are different.

16. The developer composition of claim 1, wherein the core material of the coated carrier particles and the bare carrier core particles are ferrite, iron, or nickel.

17. The developer composition of claim 1, wherein the color toner particles comprise a toner resin selected from the group consisting of styrene acrylate, styrene methylmethacrylate, and styrene butadiene.

18. The developer composition of claim 1, wherein the color toner particles comprise styrene butadiene as the toner resin.

19. The developer composition of claim 1, wherein the coating of the coated carrier particles comprises an acrylic polymer.

20. The developer composition of claim 1, wherein the coating of the coated carrier particles comprises polymethyl methacrylate and carbon black.

21. The developer composition of claim 1, wherein the color toner particles comprise a mixture of two or more colorants, one of which is black.

22. The developer composition of claim 1, wherein the color toner particles further comprises cyan colorant particles, magenta colorant particles, yellow colorant particles, or mixtures thereof.

23. The developer composition of claim 1, wherein there is selected the color toner particles comprised of the red colorant particles, wherein the bare carrier core particles are present in an amount of about 25%, based on the total weight of the bare carrier core particles and the coated carrier particles.

24. The developer composition of claim 1, wherein there is selected the color toner particles comprised of the blue colorant particles, wherein the bare carrier core particles are present in an amount of about 25%, based on the total weight of the bare carrier core particles and the coated carrier particles.

25. The developer composition of claim 1, wherein there is selected the color toner particles comprised of the green colorant particles, wherein the bare carrier core particles are present in an amount of about 15%, based on the total weight of the bare carrier core particles and the coated carrier particles.

26. A carrier composition comprising bare carrier core particles and coated carrier particles, wherein the bare carrier core particles are present in an amount ranging from about 10% to about 40%, based on the total weight of the bare carrier core particles and the coated carrier particles.

27. A method to increase the triboelectric charging value $A_t$, conductivity value, or both, of a color developer composition including color toner particles and coated carrier particles, wherein the method comprises employing bare carrier core particles in the developer composition, wherein the color toner particles comprise red colorant particles, blue colorant particles, or green colorant particles, wherein the bare carrier core particles are present in an amount ranging from about 10% to about 40% by weight for the developer composition comprised of the blue colorant particles or the red colorant particles, and wherein the bare carrier core particles are present in an amount ranging from about 10% to about 20% by weight for the developer composition comprised of the green colorant particles, based on the total weight of the bare carrier core particles and the coated carrier particles.

28. The method of claim 27, wherein there results an increase in the magnitude of the triboelectric charging value $A_t$ by about 600 or less ($10^{-2}$ microcoulombs per gram), an increase in the conductivity values by about a factor of 10 mho(cm)$^{-1}$ or less, or both, by employing an effective amount of the bare carrier core particles in the developer composition.

* * * * *